US006895378B1

(12) United States Patent
Meyer et al.

(10) Patent No.: US 6,895,378 B1
(45) Date of Patent: May 17, 2005

(54) SYSTEM AND METHOD FOR PRODUCING ACOUSTIC RESPONSE PREDICTIONS VIA A COMMUNICATIONS NETWORK

(75) Inventors: John D. Meyer, Berkeley, CA (US); Perrin Meyer, Albany, CA (US); Mark Schmieder, Emeryville, CA (US)

(73) Assignee: Meyer Sound Laboratories, Incorporated, Berkeley, CA (US)

( * ) Notice: Subject to any disclaimer, the term of this patent is extended or adjusted under 35 U.S.C. 154(b) by 571 days.

(21) Appl. No.: 09/963,095

(22) Filed: Sep. 24, 2001

Related U.S. Application Data

(60) Provisional application No. 60/234,738, filed on Sep. 22, 2001.

(51) Int. Cl.[7] ..... H04R 9/06
(52) U.S. Cl. ..... 704/270; 709/59
(58) Field of Search ..... 704/270; 709/203; 381/59

(56) References Cited

U.S. PATENT DOCUMENTS 3,239,029 A * 3/1966 Namon ..... 381/182
4,251,687 A * 2/1981 Deutsch ..... 381/305
6,373,955 B1 * 4/2002 Hooley ..... 381/335

* cited by examiner

*Primary Examiner*—Daniel Abebe
(74) *Attorney, Agent, or Firm*—Donald L. Beeson

(57) ABSTRACT

A web hosted system and method involving a client-server architecture permits audio designers to perform acoustic prediction calculations from a thin client computer. A client computer or other Internet connect device having a display screen is used by an audio professional to access via the Internet a host computer which performs acoustic prediction calculations and returns results of the calculations to the client. The results of the calculations are returned in the form of data visualizations, such as an area view showing visualizations of sound pressure levels within a defined space, an impulse view showing the time domain response at a defined location, and/or a frequency domain view showing the frequency response at a defined location. Calculations are performed based on user-defined inputs, such as speaker type and location, sent to the host computer from the client computer and based on retrieval of loudspeaker data from one or more databases accessible by the host computer.

20 Claims, 18 Drawing Sheets

SYSTEM AND METHOD FOR PRODUCING ACOUSTIC RESPONSE PREDICTIONS VIA A COMMUNICATIONS NETWORK

CROSS-REFERENCE TO RELATED APPLICATIONS

This application claims the benefit of U.S. Provisional Application No. 60/234,738 filed Sep. 22, 2000.

BACKGROUND OF THE INVENTION

The present invention generally relates to loudspeaker system design and more particularly to providing acoustic predictions for modeled loudspeaker system designs before the actual implementation of the designs.

Loudspeaker systems are used for sound re-enforcement in a wide variety of indoor and outdoor venues, ranging from small nightclubs to large concert halls and outdoor arenas. Designing a system that optimally performs in a given venue is a complex task, involving evaluation of the acoustic environment, equipment selection, and loudspeaker placement and equalization. Computer programs exist for performing acoustic predictions to assist designers and acousticians in designing optimum systems for a particular acoustic environment. Such prediction programs facilitate the design process and reduce the likelihood that a loudspeaker system, once installed, fails to meet a desired level of performance.

However, the benefits of acoustic prediction programs are not widely available to systems designers and acousticians due to the substantial computer and processing power required for these programs. Acoustic analysis and prediction involves complex calculations using large amounts of data making stand-alone applications out of the reach of most designers. Such prediction calculations also depend on the availability of current and accurate performance data for the loudspeakers to be used in the loudspeaker system design, data that is often unavailable to the designer on a timely basis, making acoustic predictions on a time critical project impractical.

The present invention overcomes access and availability problems associated with providing on demand acoustic prediction capabilities to loudspeaker system designers, acousticians, and other audio professionals. In accordance with the invention, audio professionals having only modest processing capabilities provided by a desktop computer, laptop computer, personal digital assistant ("PDA"), or other computer device can have immediate access to powerful acoustic prediction programs running on large dedicated processing systems maintained by a third party. The system of the invention also gives audio professionals instant access to current manufacturer supplied performance data for loudspeakers used in an audio system design.

SUMMARY OF THE INVENTION

Briefly, the invention is a web hosted system and method involving a client/server architecture in which a client computer or other Internet interconnect device used by an audio professional accesses a host computer which performs acoustic prediction calculations and returns the results of the calculations to the client. Preferably, the results of the calculations are returned in the form of data visualizations, such as an area view showing visualizations of sound pressure levels within a defined space, an impulse view showing the time domain response at a fixed frequency and fixed location, and/or a frequency domain view showing the frequency response at a fixed location. Calculations are performed based on user defined inputs, such as speaker type and location, sent to the host computer from the client computer and based on the retrieval of loudspeaker data from one or more databases accessible to the host computer. All scientific calculations requiring substantial processing power are performed on the host computer, while the graphical user interface ("GUI") and user defined inputs and configuration functions are all handled locally on the client side of the web hosted system.

In a further aspect of the invention, the client side of the web hosted system and method is handled entirely within the web browser of the client computer by an applet sent to the client web browser by the web server associated the host computer. In the current best mode of the invention, the client web browser will be a Java enabled web browser which receives a Java applet from the host web server. The Java applet will effectively provide a stand-alone acoustic prediction application on the client computer which operates independently of the client computer's system requirements. Thus, acoustic predictions can be performed in a web hosted environment from any client computer, regardless of the particular computer platform used by the client.

It is therefore a primary object of the present invention to provide a web hosted system and method which gives audio professionals access to complex acoustic prediction programs and the substantial processing power necessary to perform acoustic prediction calculations.

It is another object of the invention to permit acoustic predictions to be obtained from a client site which is remote from the computer hardware and software required to generate such predictions.

It is a further object of the invention to provide a web hosted acoustic prediction system and method which minimizes the local system requirements and which minimizes communications between the client and host computers.

It is still another object of the invention to provide an acoustic prediction system and method which separates the end user (client) requirements from the computational and visualization generation requirements of acoustic prediction.

It is still a further object of the invention to provide an acoustic prediction system and method which is readily accessible to all audio professionals including acousticians and audio system designers.

Other objects of the invention will be apparent to persons skilled in the art from the following description of the illustrated embodiment of the invention.

DESCRIPTION OF THE ILLUSTRATED EMBODIMENT

Figure 1:
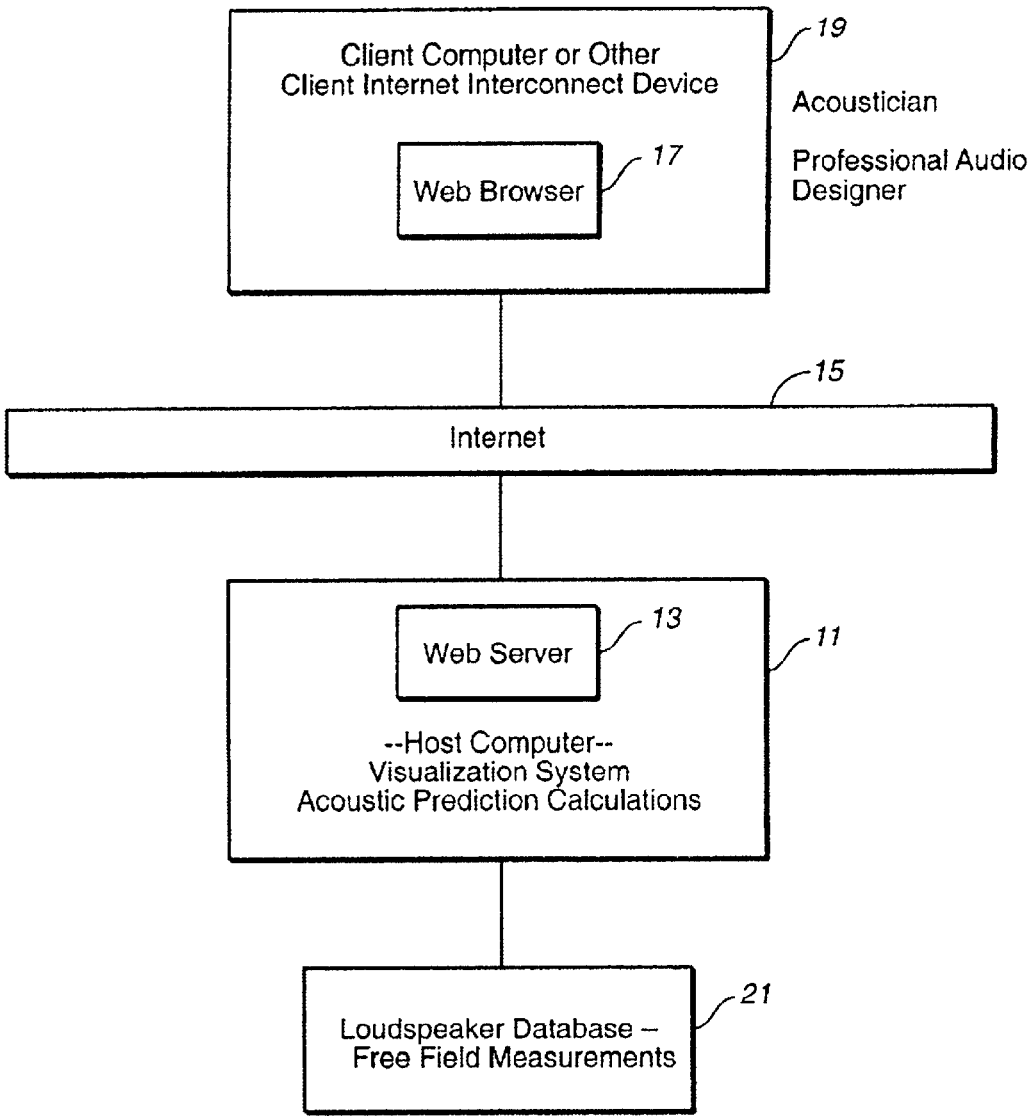
FIG. 1 is a block diagram showing a conceptual overview of a web hosted acoustic prediction system and method in accordance with the invention including a host computer and a client computer (or other Internet connect device).

Referring to FIG. 1, the web hosted system of the invention is comprised of a host computer 11 having a web server 13 which communicates over the Internet (represented by block 15) with the web browser 17 of a client computer 19 operated by an audio professional such as an acoustician or professional audio designer. The host computer will have sufficient processing and storage resources to perform acoustic prediction calculations based on input parameters sent to it by the client computer via the client computer's web browser. The size and system requirements for the host computer will be selected based on the system capabilities desired, the sophistication of the acoustic prediction program used, and data storage requirements. A loudspeaker database 21 contained within or accessible to the host computer is provided to provide the host computer with acoustic performance data for selected loudspeaker models on which acoustic predictions are based. Preferably, the loudspeaker database will contain actual measured data for the designated loudspeaker models, to provide an accurate performance profile for the loudspeaker. Measured data would include the free field polar amplitude and phase response of the loudspeaker over the loudspeaker operating frequency range. Database 21 can be periodically updated to add loudspeaker models to the database or to incorporate model changes that affect the loudspeaker's measured performance. By centralizing this database in a central host location, users of the system do not need to separately acquire, or stay current on performance specifications for a loudspeaker manufacturer's products.

It is noted that acoustic prediction calculations made by the host computer 11 result in a selected data visualization which can be transmitted to the web browser of the client computer as a specified image file. Preferably, the data visualizations are stored and sent as a .png image file, however, other image file formats could be used, such as a .jpg or .pdf image file. Different data visualizations are contemplated to present data in different formats for interpretation by the end user. The following visualizations are specifically contemplated:

1. Area view—An area view presents a visual representation of the frequency response at each point in space averaged over a specified frequency range. The area view shows variations in sound pressure level throughout the space and will reveal localized dead areas where coverage is not achieved.
2. Impulse response view—The impulse response view of the calculated response is a representation of the time domain response of the loudspeaker system at a designated location when one or more impulses are passed through the system.
3. Frequency response view—This view shows the behavior of the loudspeaker system at a particular location across all frequencies.

The different visualizations are generated from the same data set using the same core acoustic prediction algorithms. The selection of visualizations are simply a matter of selecting the format in which the calculated results are presented. This selection can be pre-programmed into the host computer or the selection can be made at the client computer by having the user input a visualization format request which is communicated to the host computer. In any event, the selected visualization or visualizations are returned to the client computer by the host computer's web server 13 via the Internet or other communications network.

It is noted that one of the objects of the invention is to minimize the required communications between the client computer and the host computer. Optimally, an acoustic prediction is made from the client computer with only a single call to the host computer which causes the acoustic prediction calculations to be made and which causes the image files with the selected data visualizations to be returned to the client's browser. All interface functions at the client computer, including buttons, dialogue windows, menus, and graphical displays will be under the control of a host supplied Java applet residing within the client's web browser.

Figure 1A:
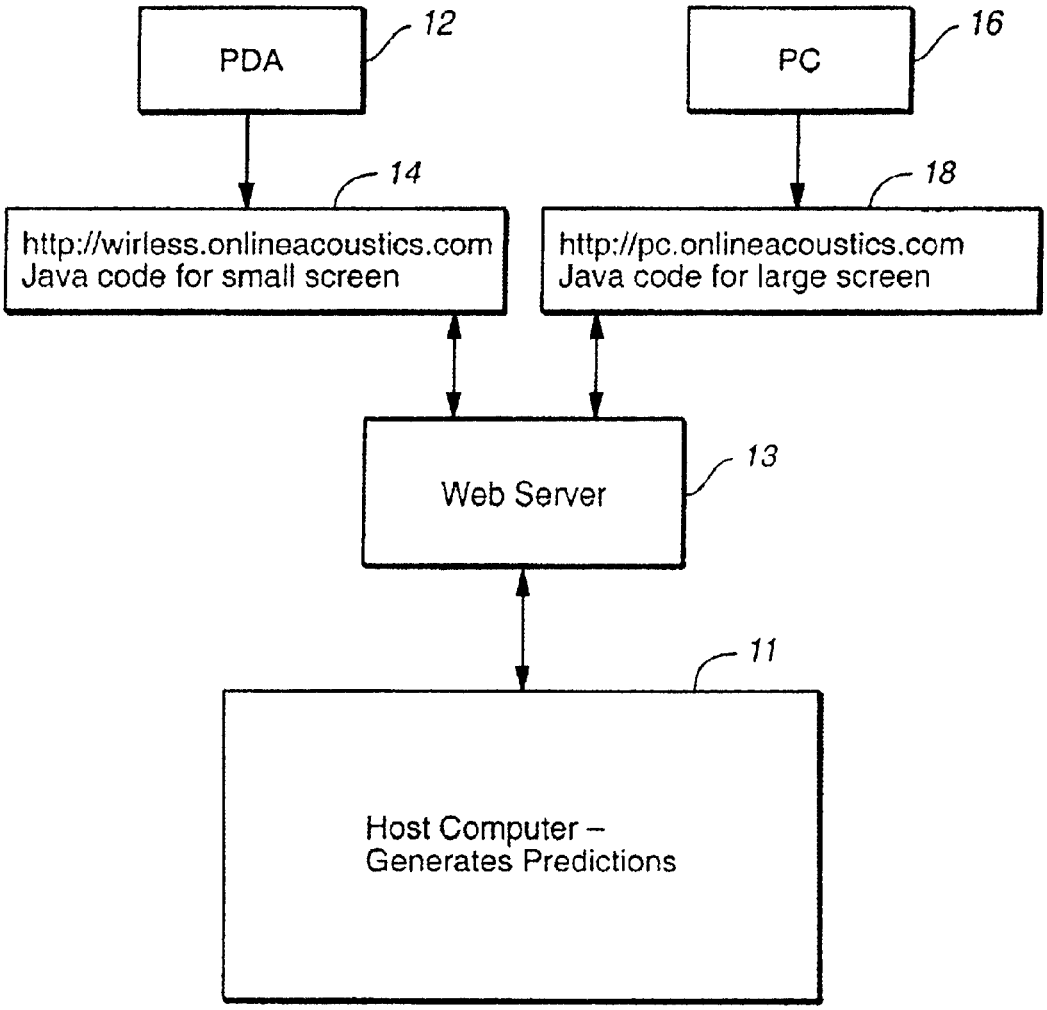
FIG. 1A is a block diagram of a web hosted acoustic prediction system and method in accordance with the invention such as shown in FIG. 1 accessible through two separate URL's selected in accordance with client device being used.

FIG. 1A illustrates a variation of the web hosted acoustic prediction program shown in FIG. 1 wherein the web server associated with the host computer can be contacted through more than one URL to permit the web server to return different Java applets depending on the URL used. This would permit the server to serve different Java applets to different client devices such as a desktop computer or wireless device.

Referring to FIG. 1A, a client having a handheld PDA device 12 is connected to the web server 13 associated with host computer 11 through one URL, for example, http://wireless.onlineacoustics.com. When connected through this URL, the web server will serve a Java applet to the PDA device 12, which is suitable for a small screen display. On the other hand, a client connecting to the web server 13 by means of a personal computer 16 will connect through a separate URL, represented by block 18, for example http://pc.onlineacoustics.com. When contacted through this URL, the web server serves Java code suitable for a large screen client device.

Figure 2:
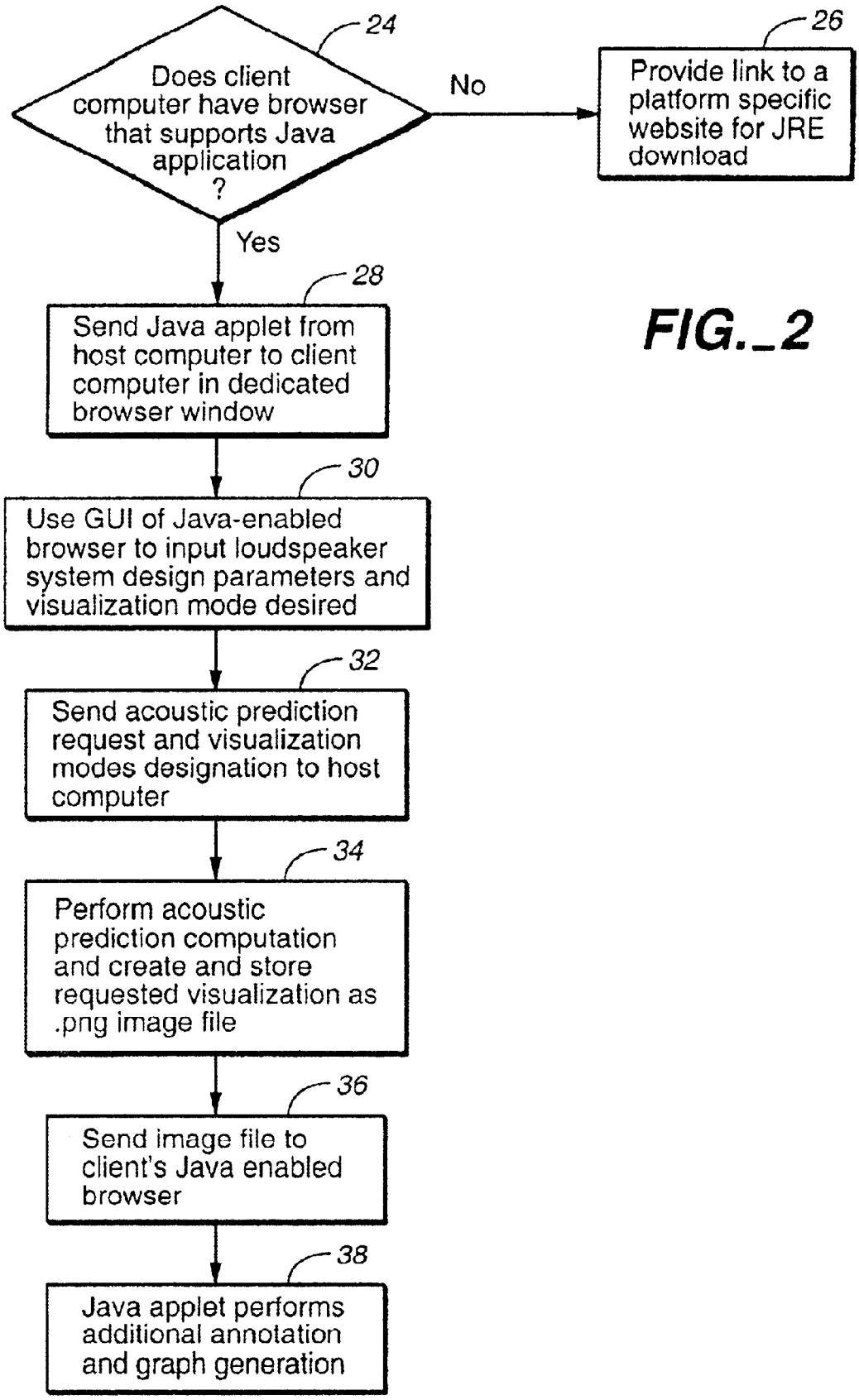
FIG. 2 is a flow chart illustrating the steps of the method of the performing acoustic predictions in accordance with the invention.

FIG. 2 illustrates a series of steps for initiating and completing an acoustic prediction from a client computer running in a Java environment. When the client's web browser first contacts the web site of the host, the host computer sends a Java script to the client computer to query the client's web browser to determine whether the browser supports the requisite level of Java for the system's acoustic prediction application. This step is represented by block 24 of FIG. 2. If the client computer does not have a browser which supports the desired level of Java, the Java script sent by the host computer links the browser to a web site that will permit the end user to download a browser which can be used with the system and method of the invention (block 26). Once it is determined that the client computer has a browser that will support the system's Java application, the host computer sends a Java applet to the client computer where it will reside within the client's web browser for future use. This applet will thereafter control the interface between the client and the host computer every time the end user uses the acoustic prediction system of the invention.

As represented by block 30, once the client's browser is Java enabled, the audio professional using the client computer uses the system to perform acoustic predictions by using the graphical user interface (GUI) produced by the Java applet. Through the Java controlled GUI, the audio professional inputs loudspeaker system design parameters needed for making acoustic prediction calculations at the host computer. Such design parameters would include speaker-type or model for each speaker used in the design, and speaker location and rotation within a defined space. A simplified version of the system might simply provide for speaker location inputs based on a pre-determined loudspeaker model. Using the GUI of the Java enabled browser, the audio professional can also designate the visualization mode desired for presenting the acoustic prediction.

As represented by block 32, once the required inputs are entered on the input screen of the client browser, the audio professional launches the audio prediction request by clicking on a suitable activation button on the input screen. Launching this request will cause the client's browser to communicate with the host computer over the Internet, and specifically to send to the host computer the formatted input data and instructions to perform an acoustic prediction calculation based on the data transmitted. The instructions to the host computer will also include the visualization format request.

As represented by block 34 of FIG. 2, the host computer, upon receiving the input data and instructions from the client's web browser, performs the acoustic prediction computation and creates and stores the results of the computation in an image file, such as a .png image file, in the visualization format requested. This image file is returned to the client's Java enabled web browser which displays the visualization within the open-browser window on the client computer (block 36).

Figure 3:
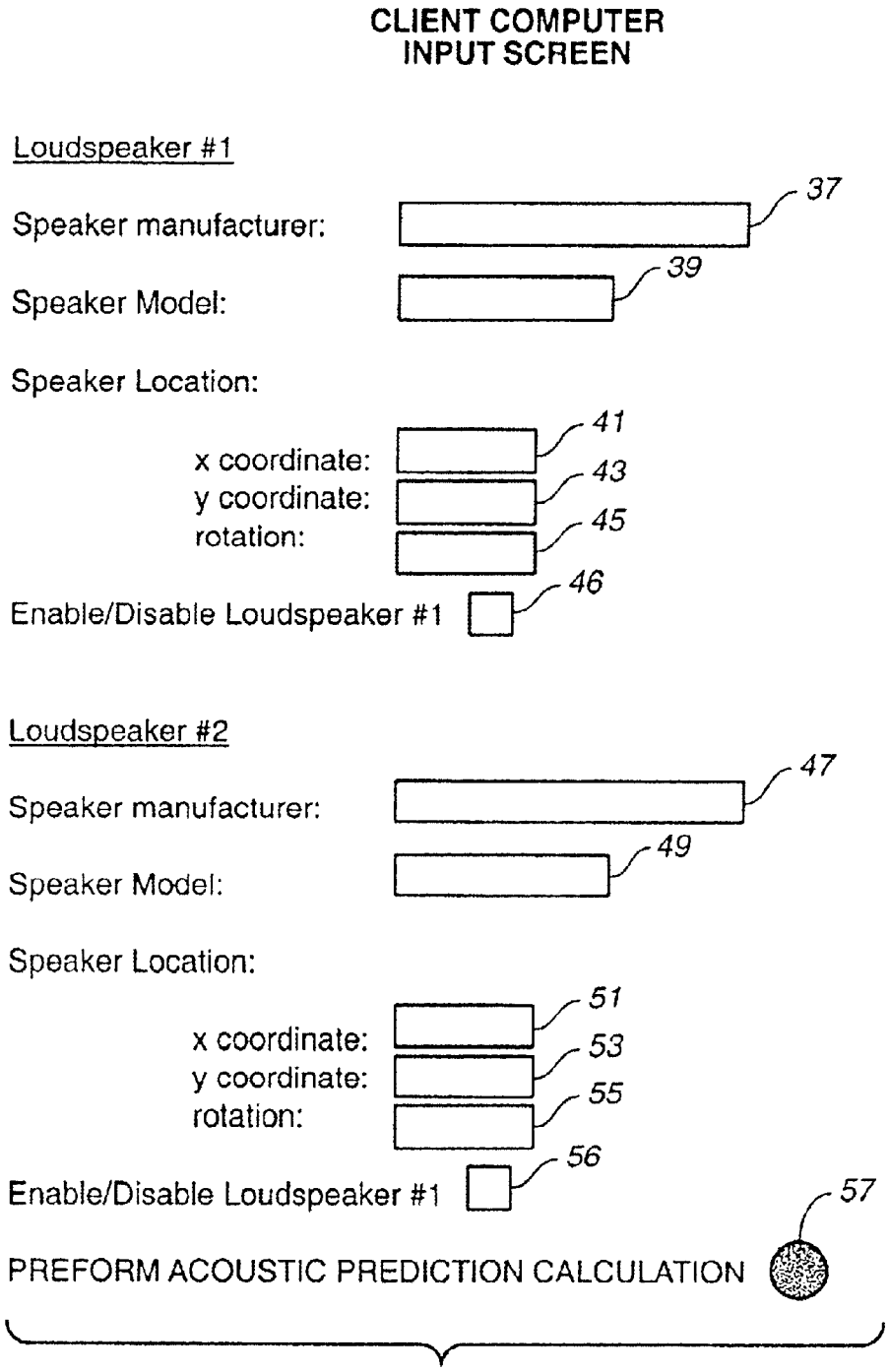
FIG. 3 illustrates a simple illustrative format for a client input screen for inputting necessary data used by the host computer to perform acoustic prediction calculations.

FIG. 3 shows a simple illustrative input screen for the client computer through which data used for acoustic predictions can be inputted at the client site of the system. The input screen illustrated in FIG. 3 allows for acoustic predictions using two loudspeakers only. It is understood that input formats can be created for multiple loudspeakers for performing acoustic predictions on more complex loudspeaker system designs.

Using the input screen of FIG. 3, the audio professional designates the speaker manufacture, speaker model, and speaker location in dialogue boxes 37, 39, 41, 43, 45. The user will be limited to speakers for which performance data is available in the loudspeaker database at the host side of the system. Suitably, available models could be choosen from a drop down menu provided at boxes 37, 39. The positioning of a loudspeaker #1 within a physical space is designated by its x-coordinate (box 41), y-coordinate (box 43), rotation (box 45). Similarly, loudspeaker #2 is identified and positioned within the physical space using dialogue boxes 47, 49, 51, 53, and 55.

With this input data, a request to perform an acoustic prediction calculation can be sent to the host computer by clicking on request button 57. The resulting acoustic prediction visualization returned to the client's browser by the host computer will be based on the acoustic performance information retrieved by the host computer from the loudspeaker database and the client supplied spacial coordinates and speaker rotation information for the designated speakers. Visualizations of the data will show how loudspeakers #1 and #2 interact with each other acoustically, and will permit the audio professional to evaluate performance using different speaker locations to improve the overall acoustic performance of the system.

The client input screen of FIG. 3 also contemplates that the audio professional can remove either loudspeaker #1 or loudspeaker #2 from the acoustic prediction calculation by selectively clicking on the enabled/disabled box 46, 56 associated with each loudspeaker. This will permit the audio designer to see how either of the loudspeakers behave alone without interaction from the other loudspeaker.

Figure 4:
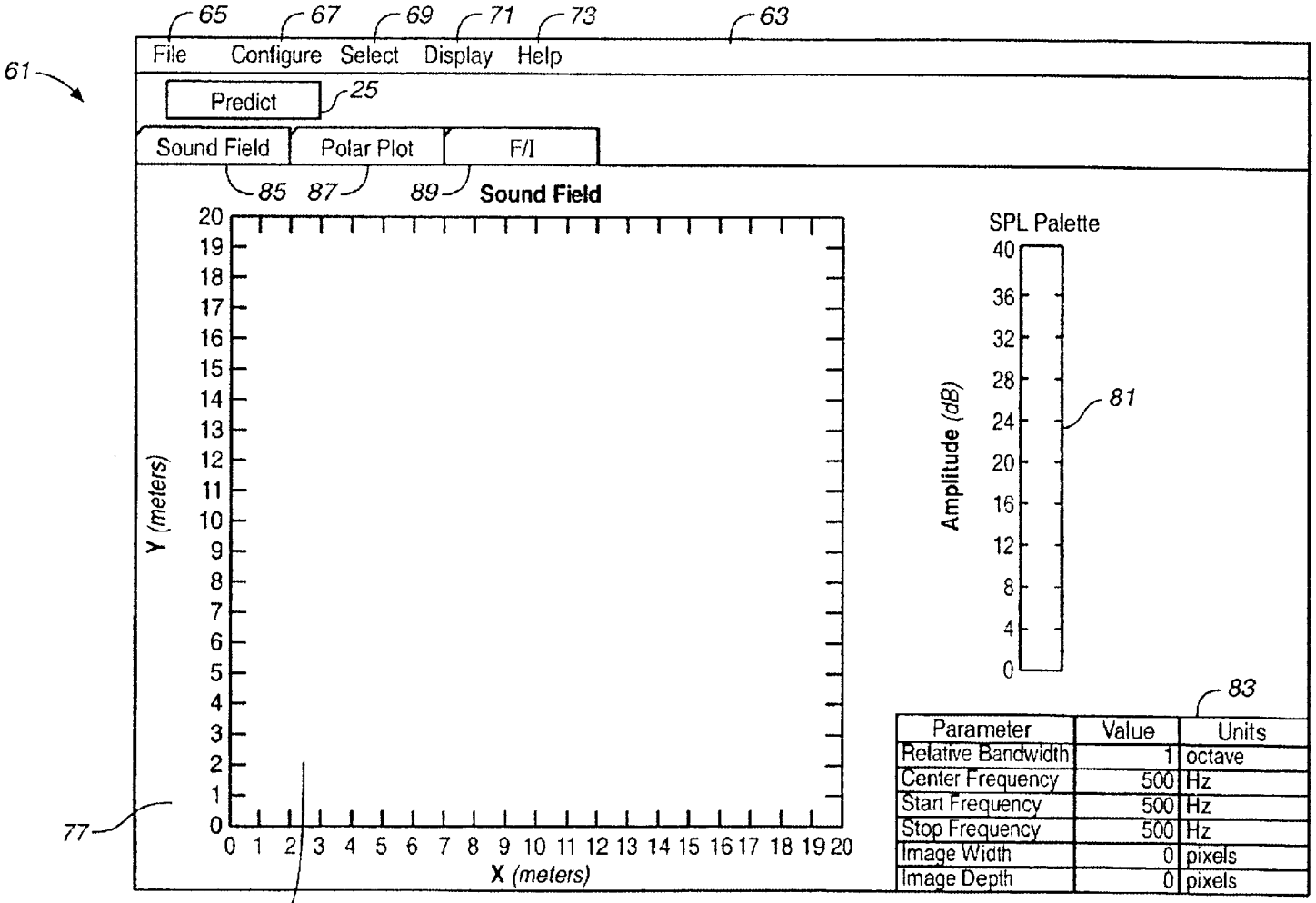
FIG. 4 is an illustration of an initial screen display of a client computer (or other Internet connect device) having an extended functionality provided by applet code received from the host computer, and showing a main menu bar with different user selectable options and a display grid representing a sound field in which selected loudspeakers of a modeled loudspeaker system can be placed by the user, and in which microphone icons representing measurement points in space can also be placed when the user desires to obtain the frequency response and/or band limited impulse response of the modeled loudspeaker system at the selected measurement point.

FIG. 4 is a pictorial illustration of a more functional client screen display for a client computer (or other Internet connect device having a screen display) running applet code received from the host computer shown in FIG. 1. Referring to FIG. 4, client screen 61 includes a main menu bar 63 having selectable "File,""Configure," "Select," "Display," and "Help," buttons 65, 67, 69, 71, 73, as well as a "Predict" button 75. The client screen further includes a display portion 77 with a display grid representing a sound field 79 having X and Y coordinates in meters defined by the X and Y axis of the sound field. The sound field provides a visual representation of a defined space in which the loudspeakers of a modeled loudspeaker system can be placed as hereinafter described, and, as also hereinafter described, in which an area view data visualization of a predicted acoustic response can be presented. Display portion 77 of client screen 61 further includes an "spl Palette" 81 which is used to assist in interpreting the presented data visualizations, and particularly the relative change in amplitude of the sound pressure level throughout the sound field represented by the shown area view date visualization. Selected parameters on which a prediction is based are also displayed in a separate parameter box 83 at the bottom right hand corner of the display. Finally, client screen 61 is further seen to include a series of display tabs 85, 87, 89, for changing to different data displays as hereinafter described.

Figure 5:
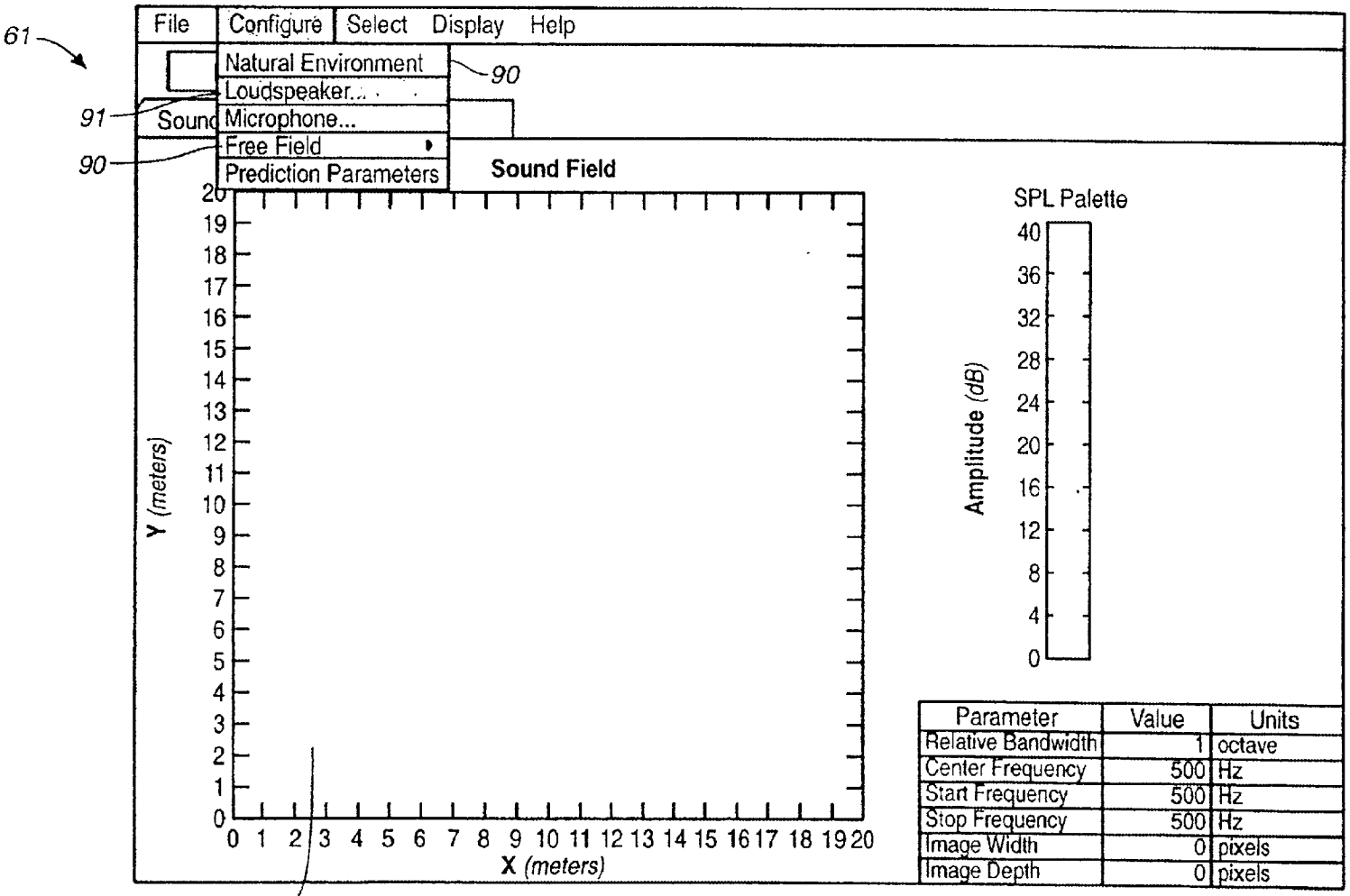
FIG. 5 is a further illustration of the client computer screen in FIG. 4 showing a drop down selection menu under the "configure" button of the main menu bar.

FIG. 5 shows the client screen display of FIG. 4 with a "Configure" drop-down menu 90 activated. This drop-down menu is seen to include the following selections: "Natural Environment," "Loudspeaker," "Microphone," "Free Field," and "Prediction Parameters." A loudspeaker is placed in the sound field 79 by clicking on the "Configure" button and then clicking on the "Loudspeaker" selection 91. The selection causes an "Add Loudspeaker" data input window to pop-up to allow the loudspeaker model to be selected and its position and other parameters to be specified by the user.

Figure 6:
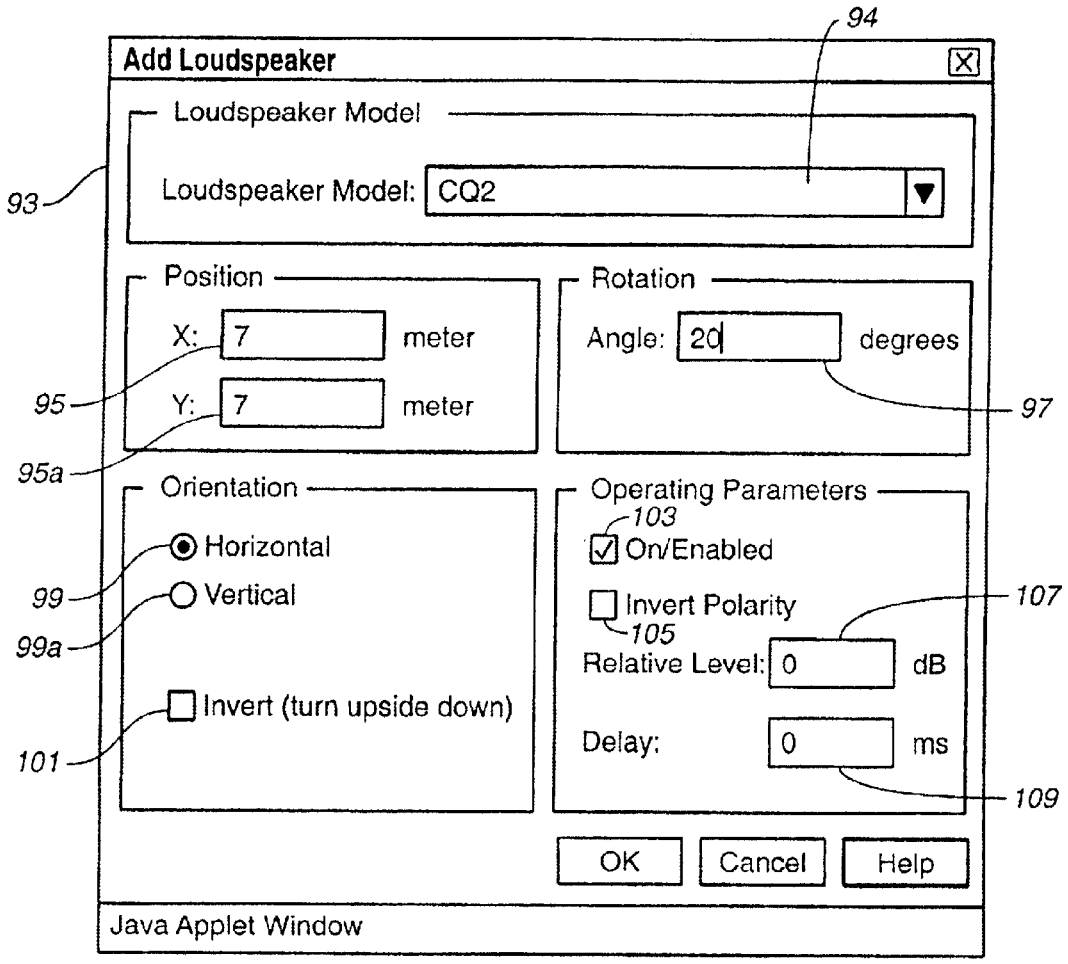
FIG. 6 illustrates a data input pop-up screen for adding loudspeakers to the sound field display seen in FIGS. 4 and 5, activated by clicking on "loudspeaker" in the "configure" drop-down menu.

FIG. 6 shows a suitable format for an "Add Loudspeaker" data input window, which is designated by the numeral 93. That data input pop-up window 93 has a drop down selection box 94 for selecting a loudspeakers model for placement in the sound field, and data input fields 95, 95*a*, and 97, for specifying the position and rotation of the selected loudspeaker. The position of the loudspeaker is specified by specifying the X and Y coordinates of the loudspeaker in the sound field using a data fields 95 and 95*a*, while the rotation is specified as an angle of rotation in the sound field using data input field 97. The "Add Loudspeaker" data input pop-up window 93 also provides for changing the orientation of a loudspeaker from horizontal to vertical by clicking one or the other of the "Horizontal" or "Vertical" bullets 99, 99*a*, while the selected loudspeaker can additionally be inverted, that is, turned upside down, by clicking on the selection box 101. The "Add Loudspeaker" data input window still further provides for the selection of various operating conditions including "Enabling" check box 103 for adding or removing the loudspeaker from a prediction, an "Invert Polarity" check box 105 for inverting the polarity of the selected loudspeaker, and further data input fields 107, 109, for specifying the spl level of the selected loudspeaker relative to other selected loudspeakers in the modeled loudspeaker system, as well as the delay of the loudspeaker relative to other selected loudspeakers. Once all user defined inputs are made in the "Add Loudspeaker" data input window, the user clicks on the "OK" button to add the loudspeaker to the sound field, whereupon the pop-up data input screen disappears.

Figure 7:
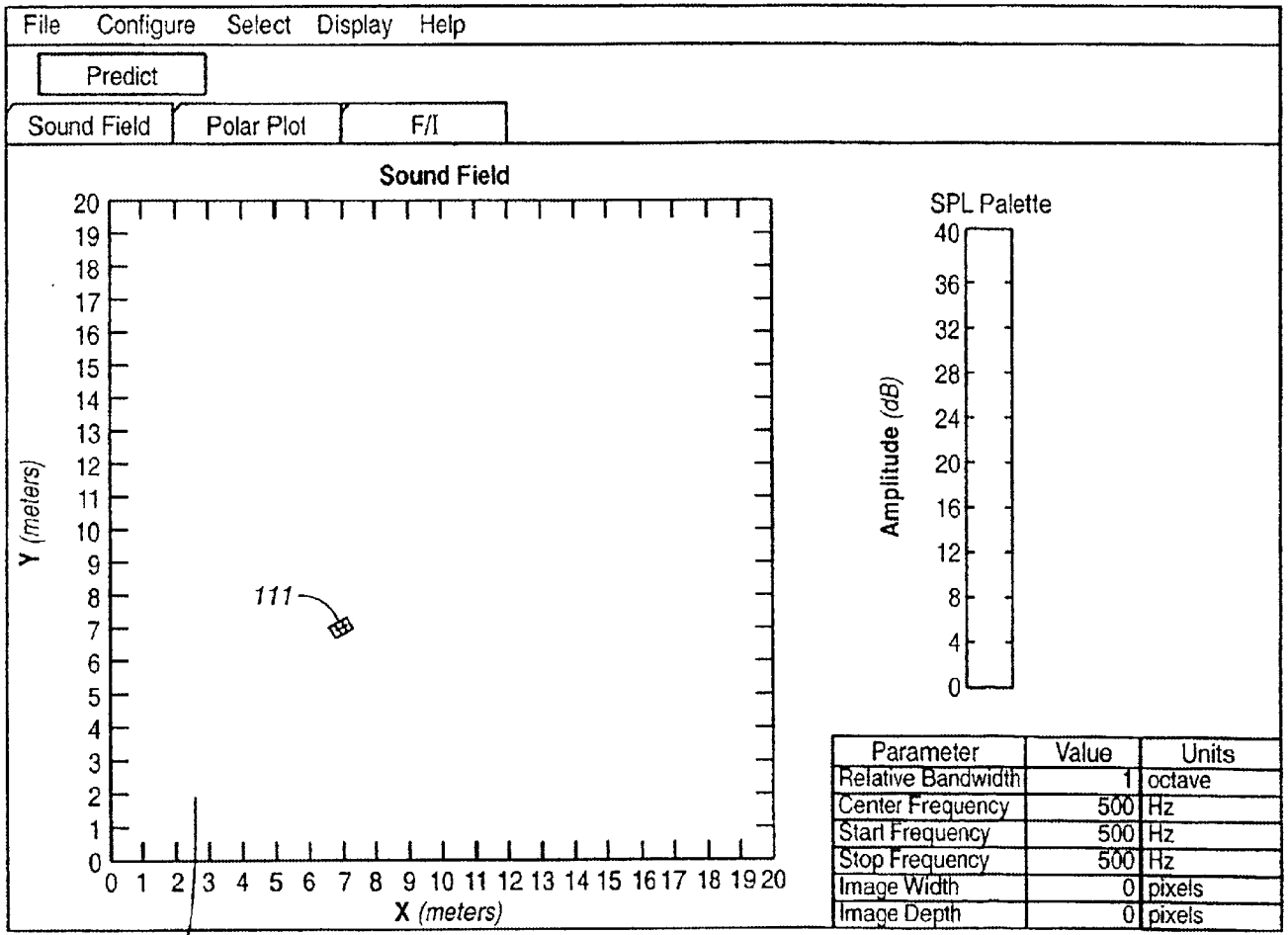
FIG. 7 is a further illustration of the client computer screen shown in FIGS. 4 and 5 with a loudspeaker added to the sound field.

FIG. 7 shows a loudspeaker icon 111 added to the sound field in accordance with the representative data inputted in the "Add Loudspeaker" data input pop-up window shown in FIG. 6. Referring to FIG. 7, it can be seen that the loudspeaker 111 has been added to the sound field at the coordinates X=7 meters and Y=7 meters, and has an angle of 20 degrees relative to the X axis. Additional loudspeakers can be added to the sound field by simply clicking again on the Configure button and selecting "Loudspeaker" from drop down selection menu and inputting new data in the data input pop-up window. The data for the additional loudspeaker can include the selection of a different loudspeaker model with a different rotation and orientation and different operating parameters. However, the coordinate position of the newly added loudspeaker would have to be different from the coordinate position of the originally added loudspeaker.

Figure 8:
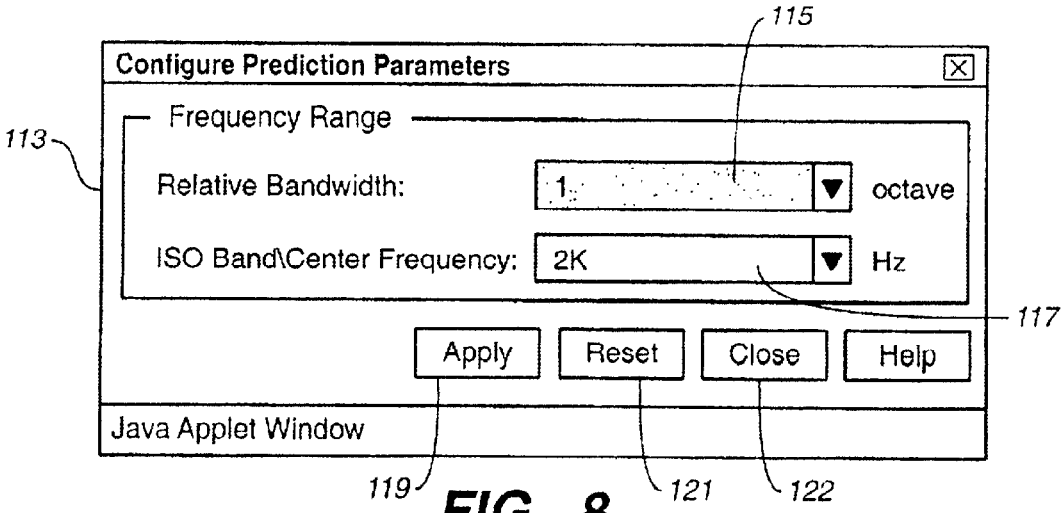
FIG. 8 shows a data input pop-up screen for inputting bandwidth and center frequency prediction parameters, and which is activated by clicking on the "Prediction "Parameters" button of the "Configure" drop-down menu.

FIG. 8 shows a "Prediction Parameters" data input pop-up window 113 used to specify the desired frequency range for the acoustic response prediction to be performed by the host computer for the modeled loudspeaker system configured in the sound field of the client screen. Frequency range is specified by selecting a relative band width (in octaves) from a drop down selection box 115 and additionally selecting the desired center frequency in the drop down selection box 117. Center frequencies are suitably selected using ISO band center frequency standards. The prediction parameters are applied by clicking the "Apply" button 119 or can be re-set by clicking the "Reset" button 121. An additional "Close" button 122 is provided for closing this pop-up window.

Figure 9:
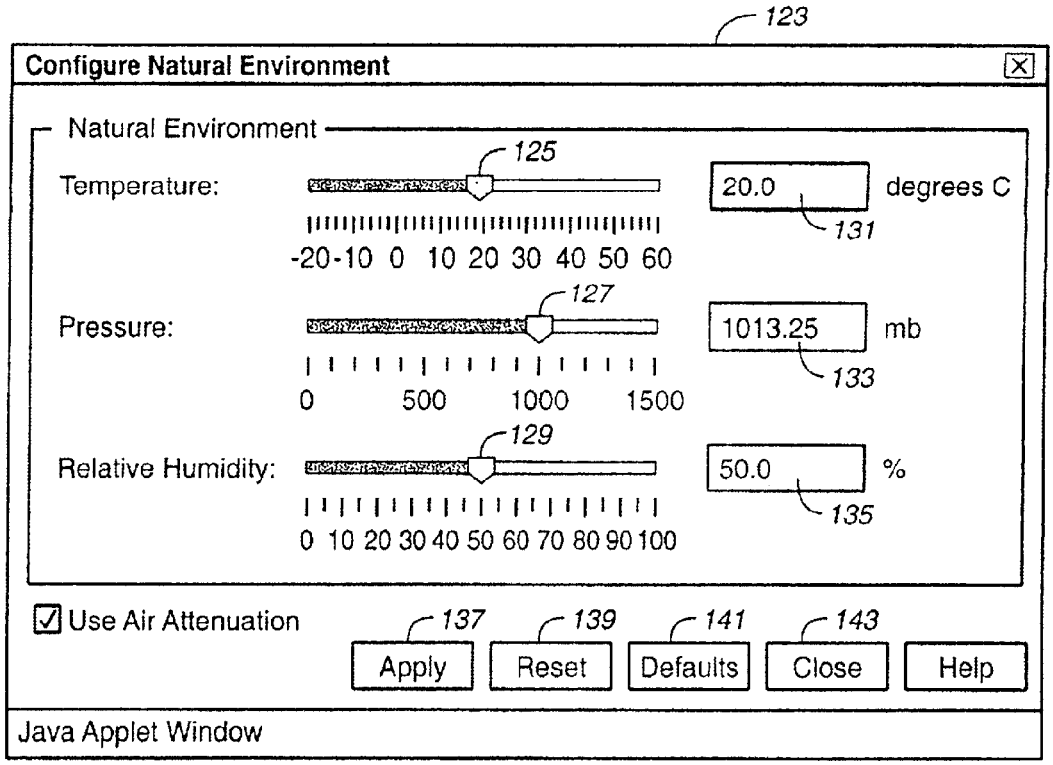
FIG. 9 illustrates a "Configure Natural Environment" data input pop-up screen activated by clicking the "Natural Environment" button of the "Configure" drop down menu.

FIG. 9 illustrates a further pop-up data input window 123 for inputting natural environment data that can be used in the acoustic response prediction. This natural environment data input window is selected by clicking on the "Natural Environment" selection of the "Configure" drop down menu. Natural environment parameters are shown as including temperature, pressure and relative humidity, all of which can be selected and adjusted by clicking and moving the respective slide buttons 125, 127, 129. As the respective slide bottons are moved, the temperature, pressure and relative humidity settings will be displayed in display fields 131, 133, 135. The selected natural environment parameters can be applied by clicking on the "Apply" button 137 and reset using the "Reset" button 139. Default temperature, pressure and relative humidity parameters can additionally be selected by clicking on default button 141. The "Close" button 143 is provided to close this pop-up window without applying the natural environment parameters.

Figure 10:
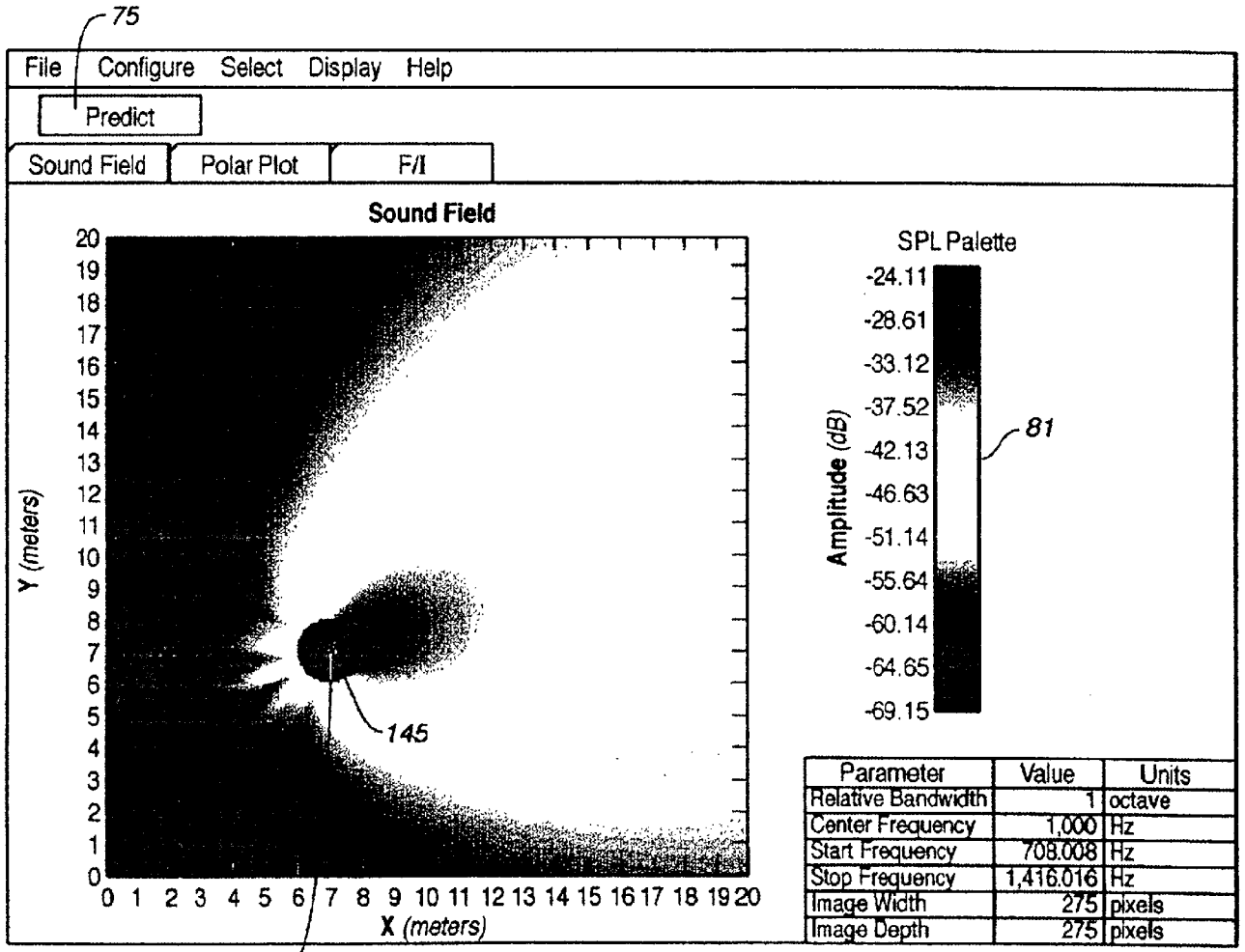
FIG. 10 shows the client computer screen of FIGS. 4 and 5, with a sample area view data visualization displayed in the sound field which has been returned by the host computer to the client computer based on a selected loudspeaker and other input parameters.

FIG. 10 shows the sound field display of the client screen after the loudspeaker has been selected and positioned, and the prediction and environmental parameters defined by the user through the pop-up screens shown in FIGS. 8 and 9. The prediction is initiated by the user by clicking on the "Predict" button 75, which causes the Java-enabled browser to send an acoustic prediction request to the host computer along with a request for the desired data visualization modes. In this case, the data visualization mode is an area of view of the acoustic response throughout the sound field surrounding the selected loudspeaker 111. It is noted that the data visualization returned and displayed in the sound field excludes near field response to about 1 meter from the loudspeaker (area 145). It is also noted that the sound pressure map provided by this area view can be interpreted in terms of relative sound pressure levels (spl) at any point within the sound field outside of area 145 by using the SPL palette 81 to the right of the sound field. Suitably, the pressure map will be provided in color with the SPL palette providing a map of colors according to spl levels.

Figure 11:
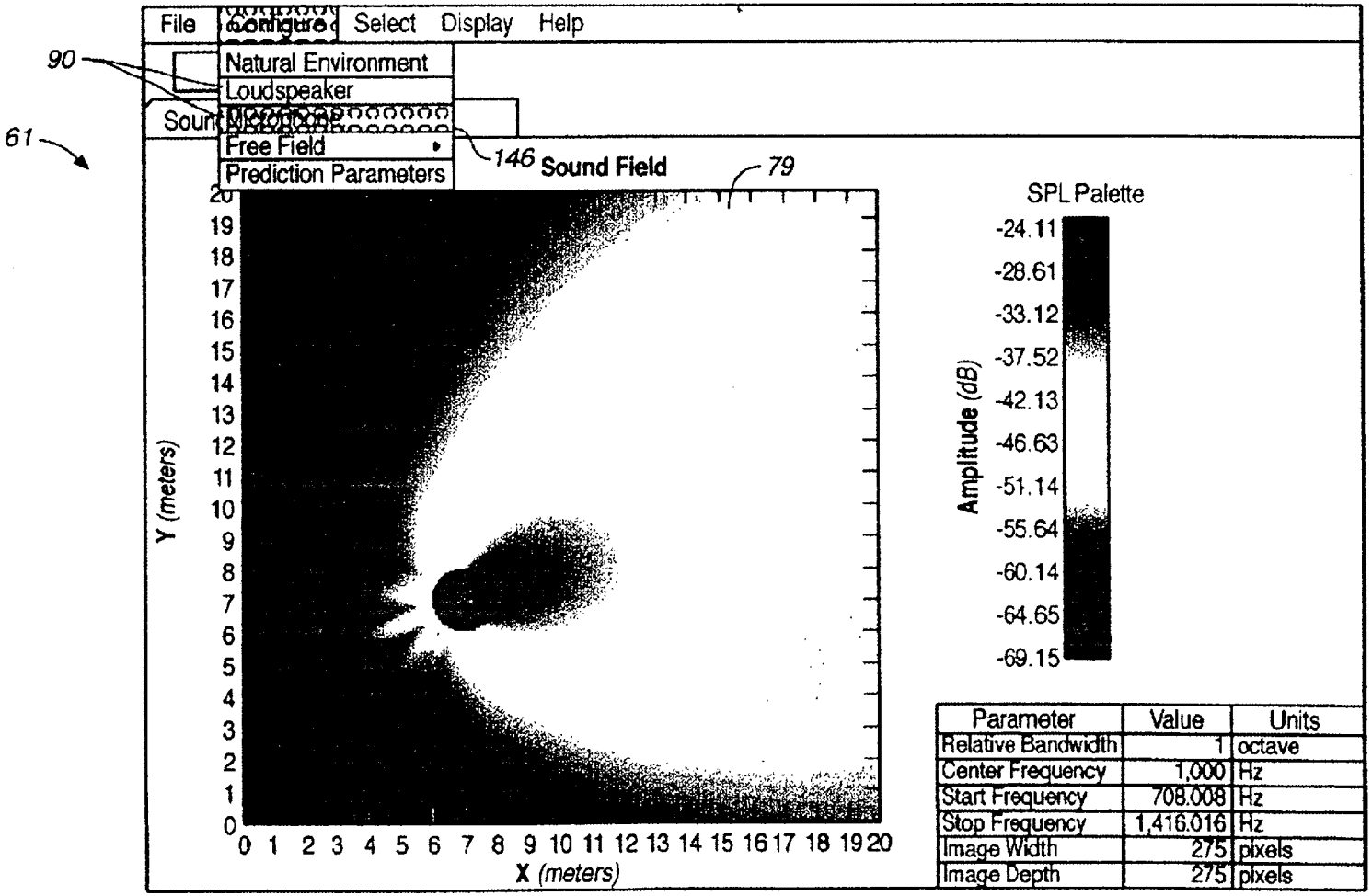
FIG. 11 is an illustration of the client computer screen shown in FIG. 10 with the "Configure" drop down menu displayed preparatory to adding a microphone to the sound field.

FIG. 11 shows the client display screen 61 with "Microphone" 146 selected on the "Configure" drop down menu 90 for adding a microphone icon to the sound field 79. One or more simulated microphones can be added to the sound field at user defined locations for the purpose of requesting data visualizations from the host computer at each microphone position in the sound field. Placement of the microphones in the sound field simulates in a visual predictive environment the use of a sound analyzer and microphones in an actual acoustic environment to measure the frequency and impulse response of an actual loudspeaker system at the location of the microphones.

Figure 12:
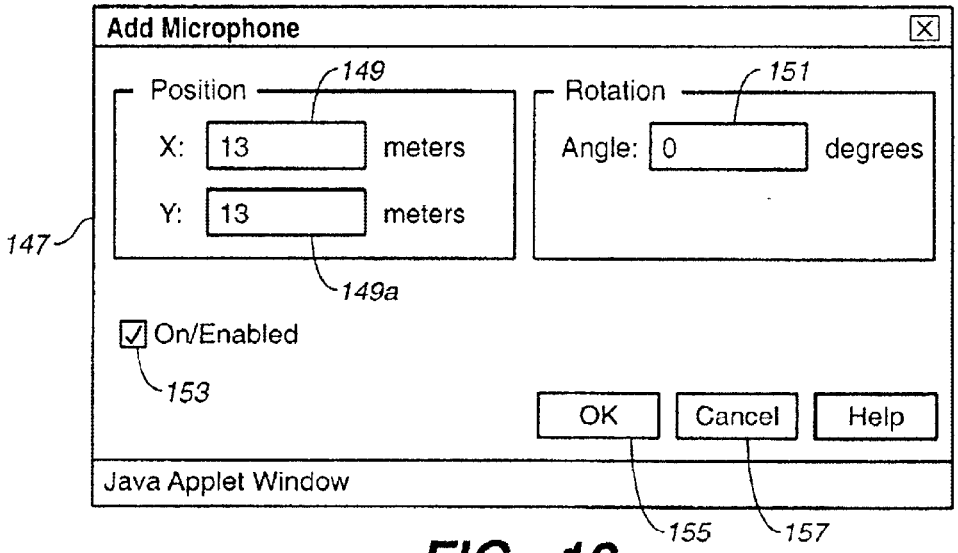
FIG. 12 shows a data input pop-up screen for an added microphone, displayed when the "Microphone" button is selected in the "Configure" drop down menu.

FIG. 12 illustrates an "Add Microphone" data input window 147 which pops up when the user clicks on the "Microphone" selection on the "Configure" drop down menu shown in FIG. 11. As seen in FIG. 12, the data input pop-up window 147 has data entry fields 149, 149*a*, 151 for specifying the position and rotation of a microphone, as well as an "Enabled" button 153 for enabling or disabling the placed microphone. It is noted that more than one, and indeed numerous microphones can be placed in the sound field for obtaining predicted frequency and impulse response at different selected locations within the simulated space, but that only one microphone would be enabled at any time when a prediction is generated by the host computer and returned to the client computer. It is also contemplated that microphones and loudspeakers can be enabled and disabled as desired by clicking directly on the loudspeaker and microphone icons in the sound field. Again, while more than one loudspeaker may be enabled, the enablement of only one microphone at a time will be permitted.

Finally, it is seen that the "Add Microphone" data input window 147 shown in FIG. 12, is provided with an "OK" button 155 and "Cancel" button 157 for, respectively, adding the specified microphone to the sound field after the position and rotation data has been entered or canceling out of the "Add Microphone" window.

Figure 13:
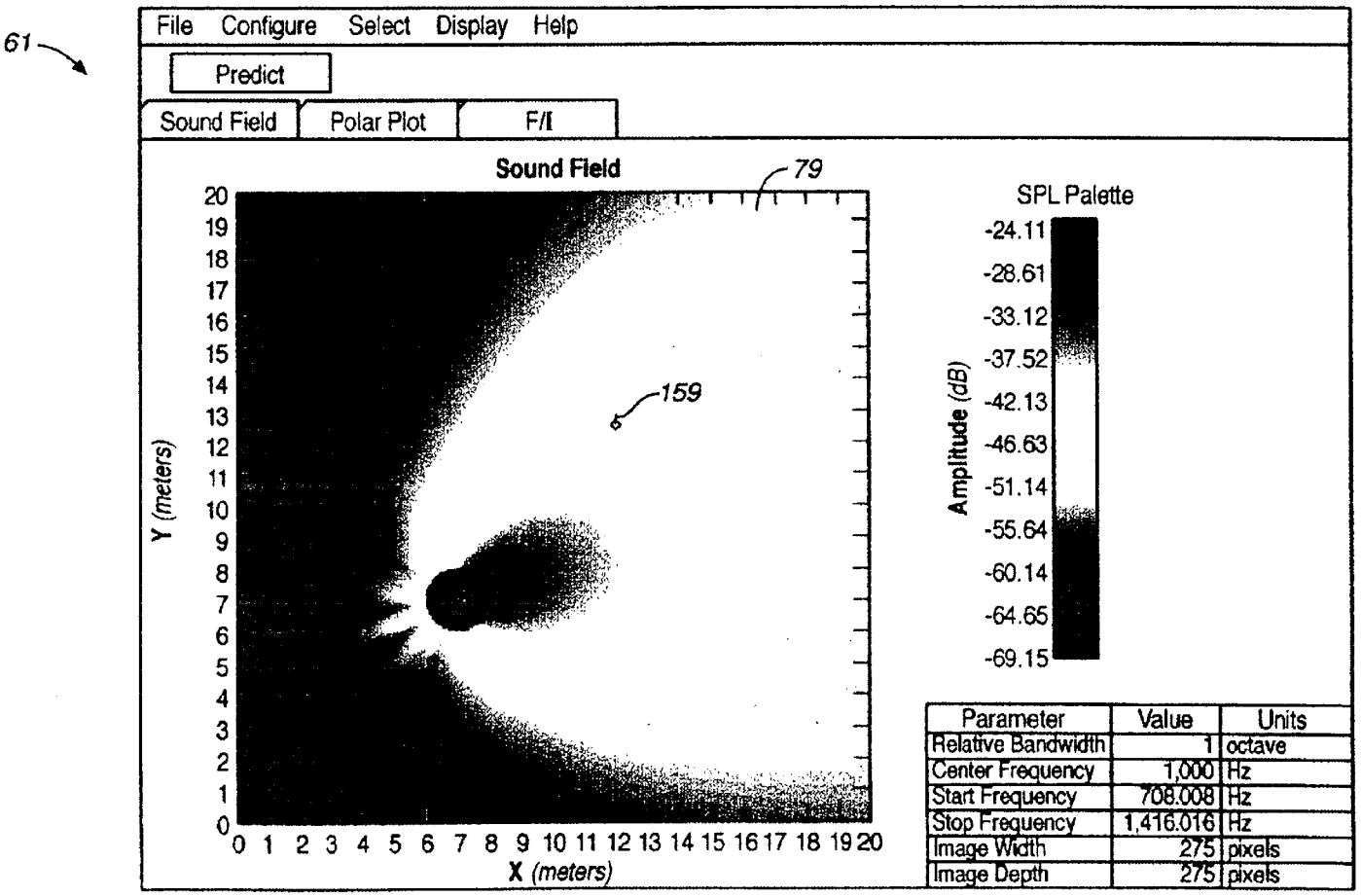
FIG. 13 is an illustration of the client computer screen of FIG. 10 showing the addition of microphone to the sound field based on the parameters inputted on the data input screen of FIG. 12.

FIG. 13 shows the sound field of the client screen with the microphone icon 159 added in accordance with the position and rotation parameters specified in the data input window 147 shown in FIG. 12. As shown in FIG. 13, the microphone icon is added at the coordinates X=13 meters and Y=13 meters. It is at this position that the frequency response and band limited impulse response will be computed by the host computer when the user clicks on the "Predict" button 75 on the client screen.

Figure 14:
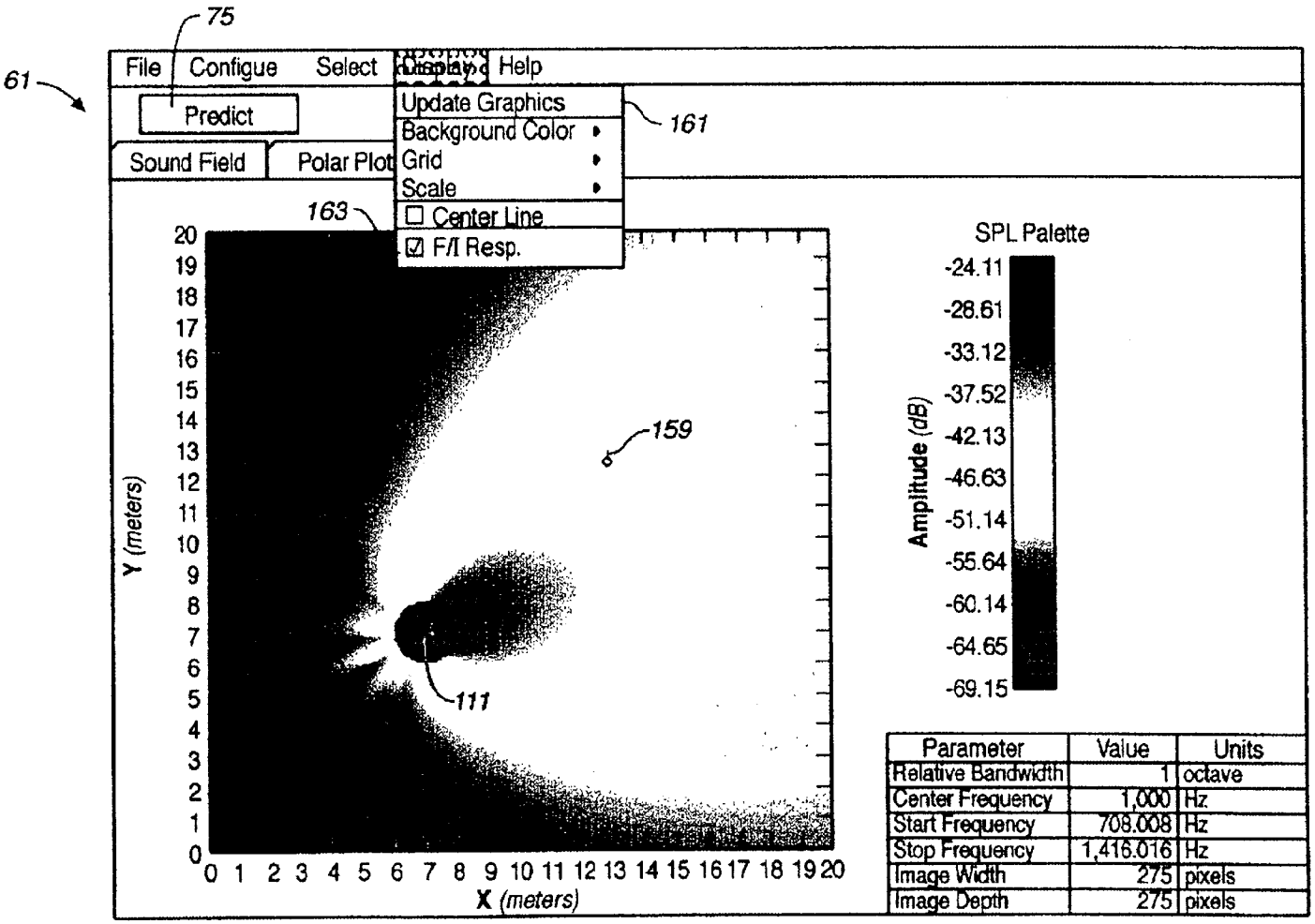
FIG. 14 illustrates the client computer screen of FIG. 12 showing a display mode drop down menu under the "Display" button of the client screen menu bar and further showing the selection of the frequency/impulse (F/I) response button.

FIG. 14 is another illustration of the client screen 61 showing the "Display" drop-down menu 161 with various selections for user modification of the screen display, and providing a selection box 163 for enabling or disabling the frequency/impulse response prediction function. When the frequency/impulse prediction response function is enabled, frequency and band limited impulse response is computed by the host computer, along with the area view when the user clicks on the "Predict" button 75. However, since predictions of the frequency response and band limited impulse response normally involves greater computational time, and consequently slows down the predicted response returned by the host computer to the client computer, disabling the frequency/impulse response function by clicking on "F/I Response" selection box 163 will remove from the request sent to the host computer any request for a frequency or impulse response prediction. This function provides the user the option of obtaining an area view response for the loudspeaker 111 relatively quickly. If the user desires to obtain both an area view response and frequency and band limited impulse responses, the F/I response function is enabled by again clicking on the "F/I Response" check box.

Figure 15:
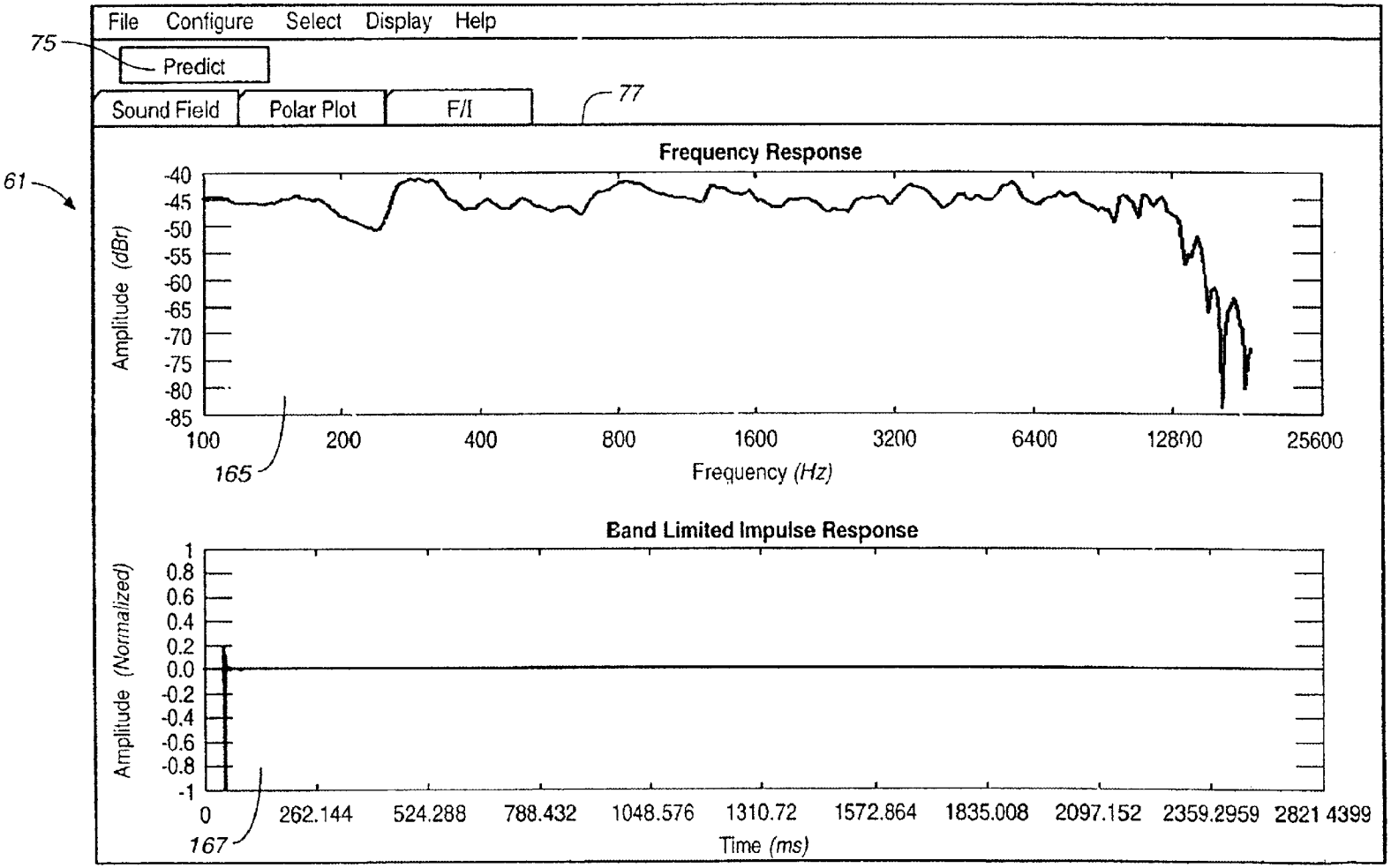
FIG. 15 illustrates a client computer screen after the "F/I Response" button has been selected with the data visualization being displayed on separate frequency domain and time domain graphs as a frequency response and band limited impulse response, instead of an area view visualization in the sound field.

FIG. 15 shows the data visualization on the client screen 61 for a predicted frequency response and band limited impulse response at the location of the microphone icon 159 in the sound field shown on the screen display of FIG. 14. This data visualization is returned by the host computer to the client computer after the user clicks on the "Predict" button 75 if the F/I response function is selected in the "Display" drop-down menu 161, also as shown in FIG. 14. This data visualization includes a frequency versus amplitude response graph 165 (a frequency response view) and amplitude versus time graph 167 (an impulse response view). If multiple microphones are placed in the sound field by the user, the acoustic response of the modeled loudspeaker in the frequency domain and time domain can be obtained by the user at any of the selected microphone locations by successively clicking on a microphone icon for the location desired and then clicking on the "Predict" button.

It is seen that once a predicted acoustic response is returned to the client computer, the user can view the area view data visualization and frequencies and impulse response data visualizations by clicking on one or the other of the "Sound Field" and "F/I Response" tabs arranged along the top of the display portion 77 of the client screen. Thus, the view shown in FIG. 15 is selected by clicking on the "F/I Response" tab, while the sound field area view display shown in FIG. 14 is displayed by clicking on the "Sound Field" tab.

Figure 16:
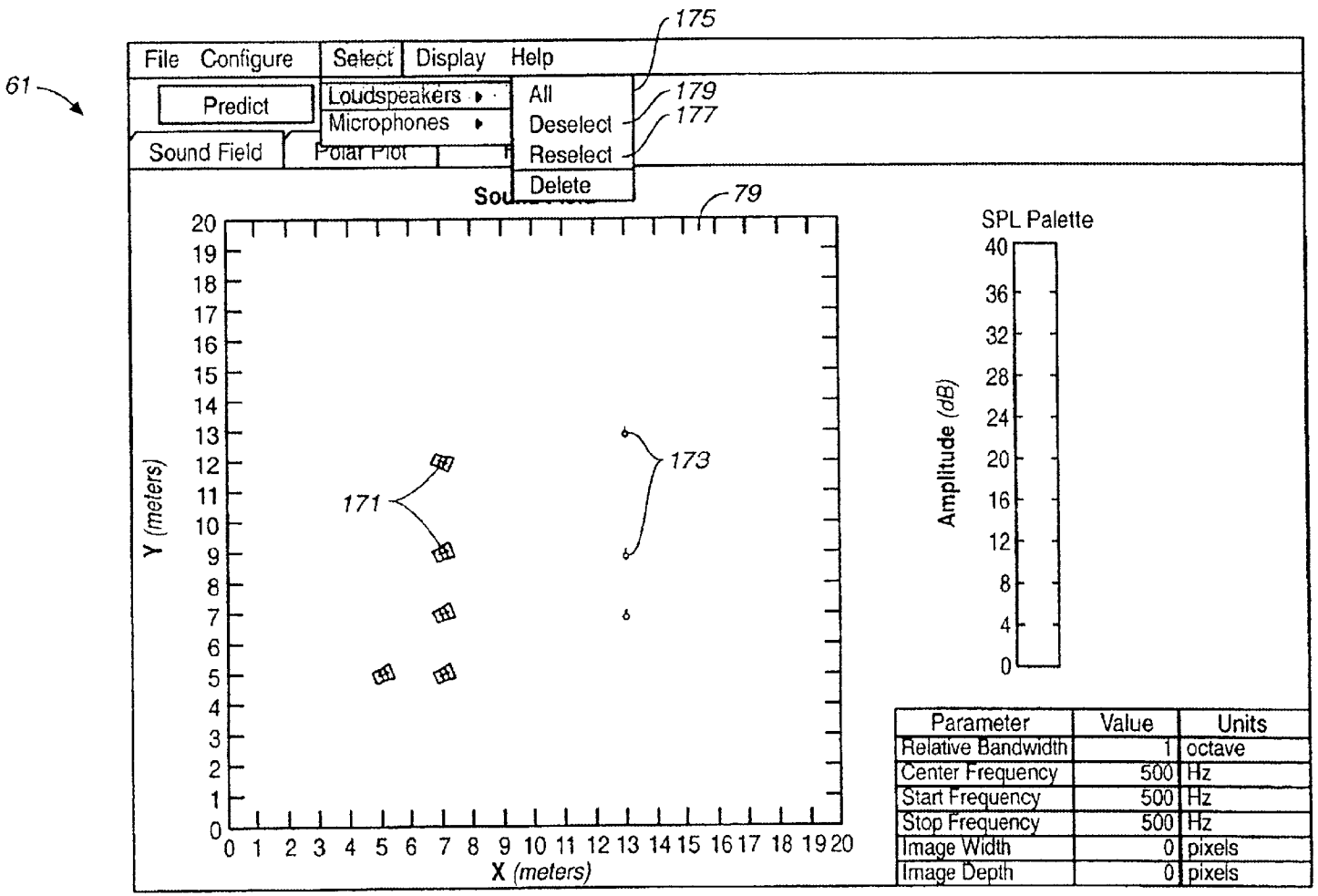
FIG. 16 illustrates the client screen display with multiple loudspeakers and microphones placed in the sound field and the "Select" drop down menu for selecting or deselecting all the loudspeakers for inclusion in the modeled loudspeaker system.
Figure 18:
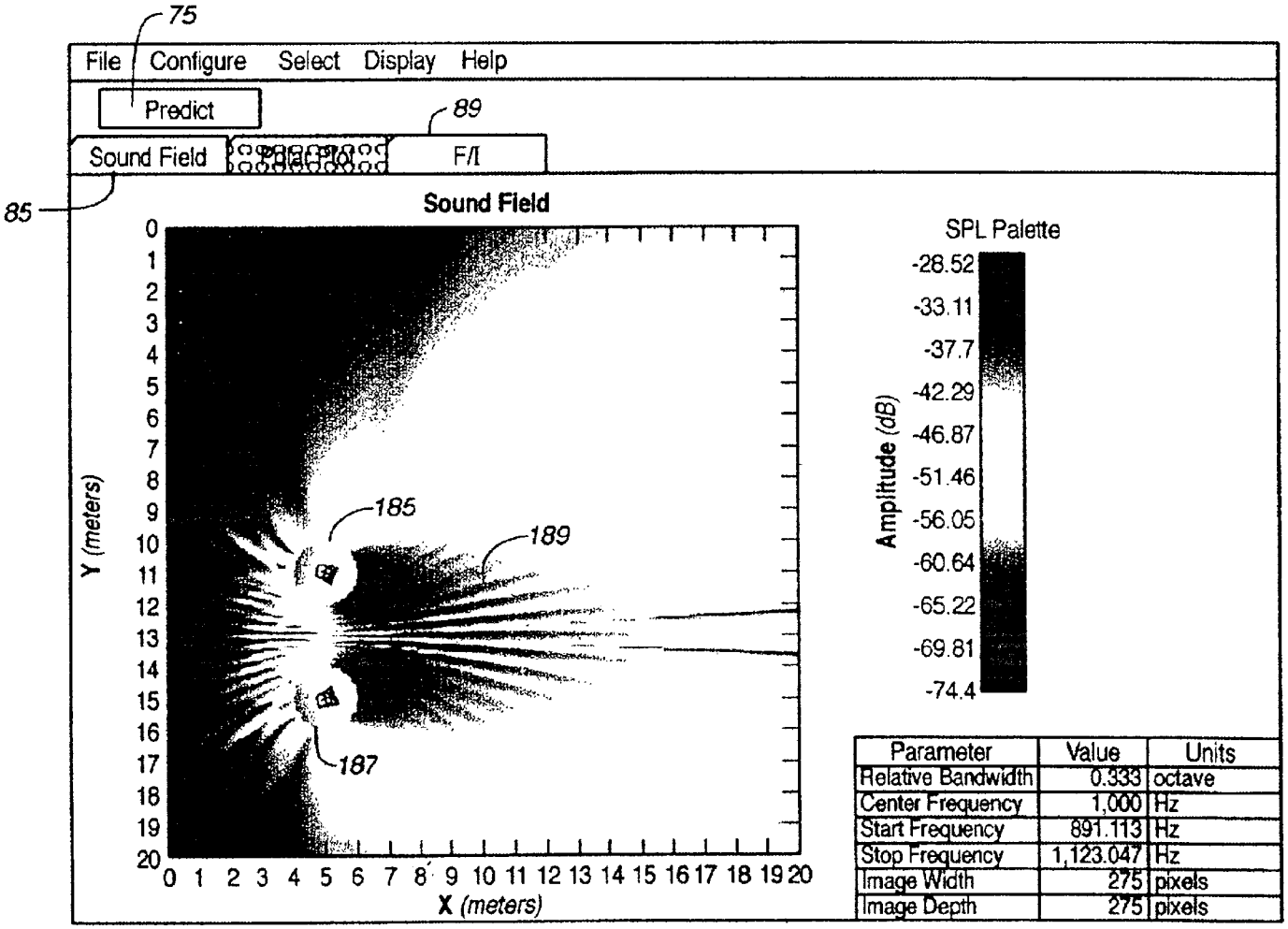
FIG. 18 illustrates the sound field display of a client computer screen with two speakers added to the sound field and showing an area view data visualization for the two loudspeakers.

FIG. 16 shows the sound field 79 of a client screen 61 with multiple loudspeakers icons 171 and multiple microphone icons 173 added to the sound field. The coordinates of each loudspeaker and microphone are determined from the X and Y axis of the sound field. FIG. 18 also shows the "Select" drop-down menu 175 which provides a facility for selecting all loudspeakers of deselecting all loudspeakers positioned in the sound field. These functions provided an added tool to the user in modeling a complex loudspeaker system with multiple speakers which can be selected or deselected for a succession of predictions.

Figure 17:
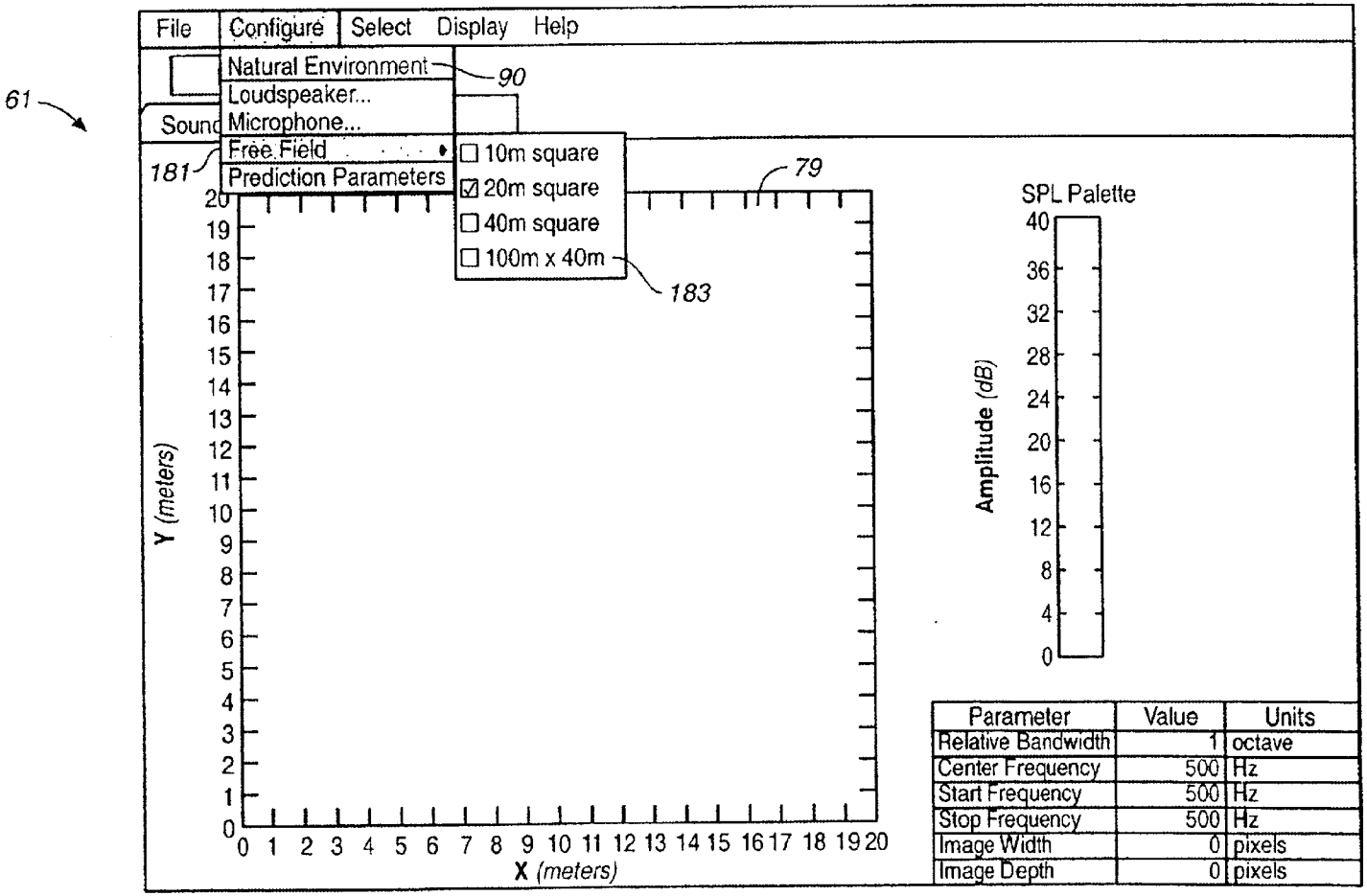
FIG. 17 shows the client screen with a submenu under the "Free Field" button of the "Configure" drop down menu.

FIG. 17 illustrates how a user can re-size the sound field in which the acoustic predictions are provided, so that the user can set up a visual sound field space on the client screen which approximates the physical space for which the user is designing a loudspeaker system. The sound field is re-sized by selecting the "Free Field" selection botton 181 in the "Configure" drop-down 15*f* menu to produce a sub-menu 183 which provides the choice of a series of selectable sound field dimensions. By clicking on the desired sound field dimensions in the sub-menu 183, the user sizes the sound field in accordance to the dimensions specified.

FIG. 18 illustrates the sound field of a client screen showing an example of an area view prediction for two loudspeakers 185, 187, which is returned from the host computer after a prediction is initiated through the "Predict" button 75. This area view is displayed with the "Sound Field" tab 85 selected. By selecting the "F/I Response" tab 89 the frequency and band limited impulse response computed at the location of the microphone icon 189 would be displayed.

Figure 19:
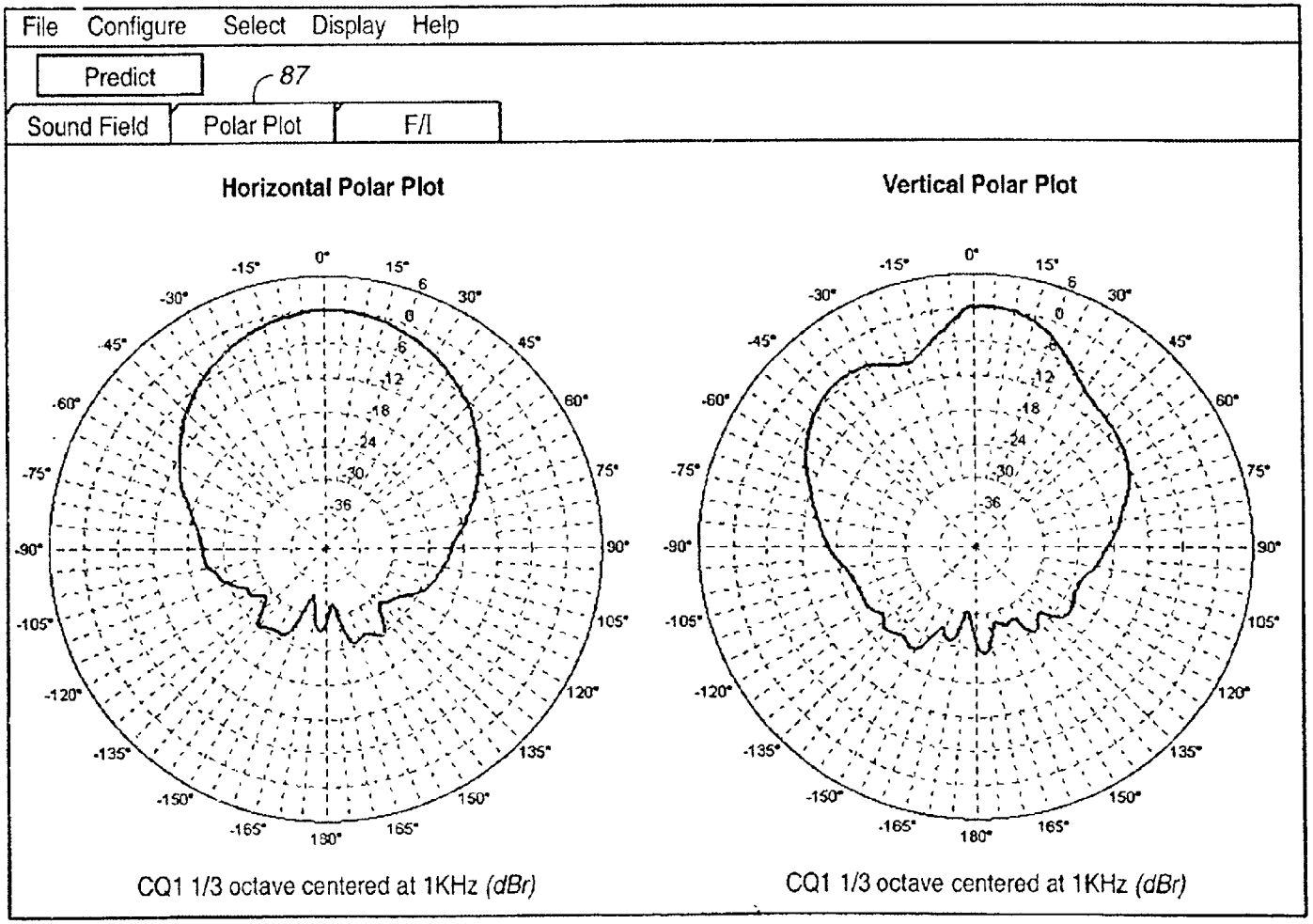
FIG. 19 illustrates a client computer screen with the "Polar Plot" tab selected for presenting the polar plots for individual selected loudspeakers.

It is contemplated that the web based system and method of the invention can also provide the user with manufacturer published information for each loudspeaker model included in the system and the performance data which are contained in the loudspeaker data base. FIG. 19 shows an example of how one form of manufacturer published information can be presented. FIG. 19 shows the horizontal polar plot and vertical polar plot for one selectable loudspeaker. These polar plots can be stored in the host computer and returned to the client computer based on the loudspeaker model placed in the sound field. Where more than one loudspeaker model is placed in the sound field, the polar plots for the individual loudspeaker models can be called up by deselecting all loudspeakers in the sound field except for the desired loudspeaker. Such polar plots are not used in the acoustic response predictions, but are provided as general information to the user. The polar plot display of FIG. 19 is displayed of the client screen by clicking on the "Polar Plot" tab 87.

To generate acoustic response predictions in accordance with the invention, a user, using a personal computer or other Internet interconnect device with a web browser first connects to the host computer via the Internet to obtain a client screen display having a sound field, as shown in FIG. 4, which is generated by an applet sent by the host computer. The user then configures his or her modeled loudspeaker system for which an acoustic response prediction is desired by placing loudspeakers of selected model types in the displayed sound field. The loudspeaker configuration in the sound field is visually presented by the loudspeaker icons to provide a visual representation of the system. The user can further place one or more microphone icons in the sound field if a frequency response and band limited impulse response prediction at the microphone location is desired. The prediction requests are then sent to the host computer by clicking on the "Predict" button on the client screen. When the data visualizations representative of the predicted acoustic response are returned to the client computer by the host computer, these data visualizations are viewed by simply clicking on the appropriate display tab along the top of the display portion of the client screen. The desired loudspeaker design can be achieved by sending successive prediction requests to the host computer based on different loudspeaker configurations in the sound field. The method and system of the invention provide a convenient tool for a designer to manipulate the components of a modeled loudspeaker system on a remote client computer in a very thin client computer application and to achieve predicted acoustic responses from a host computer having the power and capacity to generate the predictions.

Thus, the present invention provides for a system and method which makes powerful acoustic prediction capabilities widely available to audio professionals such as acousticians and audio system designers without the substantial hardware and software requirements normally associated with stand-alone sophisticated acoustic prediction programs. The system and method of the invention minimizes requirements at the client's site of the system and allows the audio professional to access the system over the worldwide web by means of a desktop computer, laptop computer or other Internet communication device, such as a PDA. Thus, the system and method of the invention opens up the possibility of complex acoustic analysis to audio professionals who cannot justify acquiring stand-alone applications at substantial cost.

While the present invention has been described in considerable detail in the foregoing specification, it is understood that it is not intended that the invention be limited to such detail, except as necessitated by the following claims.

What we claim is:

1. A method of providing a user with acoustic response predictions for a modeled loudspeaker system comprised of one or more loudspeakers having known performance characteristics, said method comprising providing a loudspeaker database containing performance characteristics for selected identifiable loudspeakers, said database being accessible by a host computer, under the control of the host computer, receiving a request over a communications network from a client computer for the prediction of the acoustic response of a modeled loudspeaker system in a defined space based on user defined inputs sent from the client computer, said user defined inputs including the identification of selected one or more loudspeakers, under the control of the host computer, retrieving from the loudspeaker database the performance characteristics of the loudspeakers identified by the request from the client computer, using the host computer to compute the acoustic response of the modeled loudspeaker system based on the user defined inputs from said client computer and the performance characteristics of the identified loudspeakers retrieved from the loudspeaker database, and over the computer network, returning to the client computer the acoustic response of the modeled loudspeaker system predicted by the computation of the host computer.

2. The method of claim 1 wherein said loudspeaker database includes measured performance criteria for selected identifiable loudspeakers.

3. The method of claim 2 wherein said measured performance criteria include free field measurements for selected identifiable loudspeakers.

4. The method of claim 2 wherein said measured performance criteria include free field amplitude and phase measurements for selected identifiable loudspeakers.

5. The method of claim 1 wherein said loudspeaker database includes performance criteria for selected identifiable loudspeakers of different manufacturers.

6. The method of claim 1 wherein the acoustic response for the modeled loudspeaker system predicted by said host computer is produced as a data visualization representative of the predicted acoustic response, and wherein said data visualization is returned by the host computer to the client computer over the communications network after the acoustic response is computed by said host computer.

7. The method of claim 6 wherein said data visualization includes an area view comprised of a visual representation of the frequency response for the modeled loudspeaker system at each point in a defined space averaged over a specific frequency range.

8. The method of claim 6 wherein the request from said client computer further specifies a measurement point within a defined space at a distance from the one or more loudspeakers of the modeled loudspeaker system, and wherein said data visualization includes a frequency domain view comprised of a visual representation of the frequency response for the modeled loudspeaker system over a range of frequencies at said specified measurement point.

9. The method of claim 6 wherein the request from said client computer further specifies a measurement point within a defined space at a distance from the one or more loudspeakers of the modeled loudspeaker system, and wherein said data visualization includes an impulse response view comprised of a visual representation of the impulse response for the modeled loudspeaker system in the time domain at said specified measurement point.

10. The method of claim 6 wherein said host computer produces data visualizations in different selectable modes and wherein, based on a request from said client computer specifying a selected one of said selectable modes, the host computer produces a data visualization in the selected mode and returns such selected mode of data visualization to the client computer.

11. The method of claim 10 wherein the selectable modes of data visualization is selected from the group consisting of:

A. an area view comprised of a visual representation of the frequency response for the 4 modeled loudspeaker system at each point in a defined space averaged over a specific frequency range, B. a frequency domain view comprised of a visual representation of the frequency response for the modeled loudspeaker system over a range of frequencies, said frequency response being predicted at a measurement point within the defined space at a distance from the one or more loudspeakers of the modeled loudspeaker system, and said measurement point being specified in the request from the client computer, and C. an impulse response view comprised of a visual representation of the impulse response for the modeled loudspeaker system in the time domain, said impulse response being predicted at a measurement point within the defined space at a distance from the one or more loudspeakers of the modeled loudspeaker system, and said measurement point being specified in the request from the client computer.

12. The method of claim 1 wherein said user defined inputs further include the position of said one or more loudspeakers in the defined space.

13. The method of claim 12 wherein the position of said one or more loudspeakers in the defined space is provided by the following user defined inputs: the co-ordinates of the one or more loudspeakers in the defined space, and the rotation of the one or more loudspeakers in the defined space.

14. The method of claim 1 wherein the user defined inputs further include the frequency range over which the acoustic prediction is to be made.

15. The method of claim 14 wherein the frequency range is specified by specifying a center frequency and relative bandwidth about the center frequency.

16. The method of claim 1 wherein said user defined inputs include natural environment parameters within the defied space which affect the acoustic response computations.

17. The method of claim 16 wherein said natural environment parameters include temperature.

18. The method of claim 16 wherein said natural environment parameters include atmospheric pressure.

19. The method of claim 16 wherein said natural environment parameters include relative humidity.

20. A method of providing a user with acoustic response predictions for a modeled loudspeaker system comprised of one or more loudspeakers having known performance characteristics, said method comprising providing a loudspeaker database containing performance characteristics for selected identifiable loudspeakers, said database being accessible by a host computer, under the control of the host computer, receiving a request over a communications network from a client computer for the prediction of the acoustic response of a modeled loudspeaker system in a defined space based on user defined inputs sent from the client computer, said user defined inputs including the identification of selected one or more loudspeakers and a selected data visualization mode in which produce an acoustic response, under the control of the host computer, retrieving from the loudspeaker database the performance characteristics of the loudspeakers identified by the request from the client computer, using the host computer to compute the acoustic response of the modeled loudspeaker system based on the user defined inputs from said client computer and the performance characteristics of the identified loudspeakers retrieved from the loudspeaker database, said acoustic response being produced in the data visualization mode selected in the user defined inputs, over the computer network, returning to the client computer the acoustic response of the modeled loudspeaker system predicted by the computation of the host computer in the selected data visualization mode.

* * * * *

UNITED STATES PATENT AND TRADEMARK OFFICE

CERTIFICATE OF CORRECTION

PATENT NO. : 6,895,378 B1 
DATED : May 17, 2005
INVENTOR(S) : John D. Meyer, Perrin Meyer and Mark Schmieder It is certified that error appears in the above-identified patent and that said Letters Patent is hereby corrected as shown below:

Title page,
Item [60], Related U.S. Application Data, "Provisional application No. 60/234,738, filed on September 22, 2001" should read -- Provisional application No. 60/234,738, filed on September 22, 2000 --.

Drawings,
On sheet 11, Fig. 11, the word -- Configure -- should appear in the upper left-hand corner of the drawing next to "File", and the word -- Microphone -- should appear below it, just below "Loudspeaker" and above "Free Field".
On sheet 13, Fig. 14, the word -- Display -- should appear at the top of the drawing between "Select" and "Help".
On sheet 17, Fig. 18, the words -- Polar Plot -- should appear in the upper left-hand corner of the drawing between "Sound Field" and "F/I".

Column 3,
Line 41, add an -- a -- between the words "of" and "microphone".

Column 6,
Line 38, "choosen" should read -- chosen --.

Column 8,
Line 5, add a -- the -- between the words "from" and "drop".
Line 36, "bottons" should read -- buttons --.

Column 10,
Line 33, "of" should read -- or --.
Line 43, "botton" should read -- button --.

Column 11,
Line 8, "of" should read -- on --.

Column 12,
Line 11, "using" should begin a new paragraph on line 12.

UNITED STATES PATENT AND TRADEMARK OFFICE

CERTIFICATE OF CORRECTION

PATENT NO. : 6,895,378 B1 
DATED : May 17, 2005
INVENTOR(S) : John D. Meyer, Perrin Meyer and Mark Schmieder It is certified that error appears in the above-identified patent and that said Letters Patent is hereby corrected as shown below:

Column 13,
Line 39, "defied" should read -- defined --.

Signed and Sealed this

Second Day of August, 2005

JON W. DUDAS
*Director of the United States Patent and Trademark Office*

UNITED STATES PATENT AND TRADEMARK OFFICE

CERTIFICATE OF CORRECTION

PATENT NO. : 6,895,378 B1
APPLICATION NO. : 09/963095
DATED : May 17, 2005
INVENTOR(S) : John D. Meyer, Perrin Meyer and Mark Schmieder It is certified that error appears in the above-identified patent and that said Letters Patent is hereby corrected as shown below:

Col. 12, line 17, "computer network" should read --communications network--.
Col. 14, line 35, "computer network" should read --communications network--.

Signed and Sealed this

Fifth Day of August, 2008

JON W. DUDAS
*Director of the United States Patent and Trademark Office*